United States Patent [19]

Mergenthaler

[11] Patent Number: 4,805,066

[45] Date of Patent: Feb. 14, 1989

[54] HYBRID FLOAT SWITCH

[76] Inventor: Robert Mergenthaler, 2945 State Road 84, Fort Lauderdale, Fla. 33312

[21] Appl. No.: 97,947

[22] Filed: Sep. 17, 1987

[51] Int. Cl.[4] ..... H01H 35/18

[52] U.S. Cl. ..... 361/178; 73/308; 340/624; 200/84 C; 417/40

[58] Field of Search ..... 340/623, 624; 73/308, 73/313, 314; 335/206; 361/178; 417/40; 307/118; 200/84 R, 84 C

[56] References Cited

U.S. PATENT DOCUMENTS

| | | | |
|---|---|---|---|
| 3,646,293 | 2/1972 | Howard | 200/84 C |
| 3,982,087 | 9/1976 | Bachman | 200/84 C |
| 4,015,226 | 3/1977 | Stomma | 335/206 |
| 4,186,419 | 1/1980 | Sims | 361/178 |
| 4,227,236 | 10/1980 | Kubler | 335/206 |

*Primary Examiner*—Gerald P. Tolin
*Attorney, Agent, or Firm*—Dale Paul DiMaggio

[57] ABSTRACT

A combination hybrid float switch comprising float support means, float support means including a top and a bottom and an internal tube, the internal tube being sealed with respect to a liquid encountering the float support means. A float means is slidably positioned about the internal tube, the float means including a magnet means, the float means being responsive to the level of the liquid. A circuit board means is positioned within the internal tube and includes a plurality of magnetic reed switches. The reed switches are mounted upon the circuit board, the plurality including a first enable switch, second pump switch and a third alarm switch. The pump switch and the alarm switch are physically aligned in a parallel position above the enable switch, the enable switch and the alarm switch each being modified with one shortened lead, thereby modifying the reaction to a magnetic field. the modified reeds eliminate an otherwise conventionally act of state. The magnet means actuates the enable switch, the pump switch, and the alarm switch, respectively, as the float rises in response to the liquid. The plurality of reed switches provides an off state, a pump active state, and an alarm active state, in sequence. Also included is a pump circuit means an an alarm circuit means, which are responsive to the pump active state and the alarm active state.

7 Claims, 3 Drawing Sheets

HYBRID FLOAT SWITCH

BACKGROUND OF THE INVENTION

The subject matter of this invention relates to float switches, and more particularly to a combination hybrid float switch for use with marine vessels and bilge pumps.

The technology for automatically monitoring and controlling liquid levels has rapidly developed in recent years. This technology has encompassed the use of reed switches, which have contacts mounted on magnetic reeds sealed in a glass tube, designed for actuation by an external magnetic field. An example of such an apparatus is shown in U.S. Pat. No. 4,186,419 issued to B. Sims. This patent teaches of a device using a plurality of reed switches which are used to employ the automatic detection of a rising liquid and in sequence actuate a pump and alarm system.

However, the present technology fails to address the inherent operational flaws associated with commercially available reed switches. A typical reed switch will exhibit the characteristics of going from a magnetically active state, to a brief "dead zone" or inactive state, again experience an act of state, again experience a brief "dead zone", and finally experience another active state, as a magnetic field passes by a stationary reed switch. The inactive or "dead zones" are caused by the physical and inherent parameters associated with the magnetic fields. A typical magnetic field is found in the vicinity of a magnetic body or current carrying medium and creates magnetic lines of flux or force. These lines are used to represent the magnetic induction of the field, and indicate at what point and what force is presented by the field. As a magnet passes by a reed switch there are areas of inactivity which are not acted upon by the magnetic flux. This is what creates the "dead zones" or inactive states as the magnet passes by the reed. This creates the problem that the reed switch will not have a continuous state when it is acted upon by the passing magnet. Therefore, artisans have developed latching circuitry or a design utilizing parallel or staggered reed switches to account for this dilemma. This has resulted in the use of an undesirably large number of reed switches to be used, and has also resulted in the necessity for a larger physical unit to accommodate the number of reed switches and associated circuitry and circuit board structures.

It is therefore highly desirable to provide a hybrid float switch which utilizes a minimum number of reed switches in order to maximize the operational active states of a device for automatically monitoring and controlling liquid levels.

It is also highly desirable to provide a hybrid float switch which utilizes modified reed switches containing one shortened lead, thereby modifying their reaction to a magnetic field, the modified reeds eliminating an otherwise conventionally occurring active state.

It is also highly desirable to provide a hybrid float switch utilizing modified reed switches which accommodate smaller physical unit which are readily adaptable to marine vessels and conventional bilge pumps, as well as other dimensional restraints.

It is also highly desirable to provide a hybrid float switch which is cost effective yet operationally efficient.

It is also highly desirable to provide a hybrid float switch which eliminates complications involved in alignment of multiple reeds, and maximizes the response and accuracy of the device.

Finally, it is highly desirable to provide a hybrid float switch which incorporates all the above mentioned features and objects.

SUMMARY OF THE INVENTION

It is therefore an object of the invention to provide a hybrid float switch which utilizes a minimum number of reed switches in order to maximize the operational active states of a device for automatically monitoring and controlling liquid levels.

It is therefore an object of the invention to provide a hybrid float switch which utilizes modified reed switches containing shortened leads, thereby modifying their reaction to a magnetic field, the modified reeds eliminating an otherwise conventionally occurring active state.

It is therefore an object of the invention to provide a hybrid float switch utilizing modified reed switches which accommodate smaller physical unit which are readily adaptable to marine vessels and conventional bilge pumps, as well as other dimensional restraints.

It is therefore an object of the invention to provide a hybrid float switch which is cost effective yet operationally efficient.

It is therefore an object of the invention to provide a hybrid float switch which eliminates complications involved in alignment, and maximizes the response and accuracy of the device.

Finally, it is an object of the invention to provide a hybrid float switch which incorporates all the above mentioned features and objects.

Briefly, what is provided is a hybrid float switch comprising float support means, float support means including a top and a bottom and an internal tube, the internal tube being sealed with respect to a liquid encountering the float support means. A float means is slidably positioned about the internal tube, the float means including a magnet means, the float means being responsive to the level of the liquid. A circuit board means is positioned within the internal tube and includes a plurality of magnetic reed switches. The reed switches are mounted upon the circuit board, the plurality including a first enable switch, second pump switch and a third alarm switch. The pump switch and the alarm switch are physically aligned in a parallel position above the enable switch, the enable switch and the alarm switch each being modified with one shortened lead, thereby modifying the reaction to a magnetic field. The modified reeds eliminate an otherwise conventionally act of state. The magnet means actuates the enable switch, the pump switch, and the alarm switch, respectively, as the float rises in response to the liquid. The plurality of reed switches provides an off state, a pump active state, and an alarm active state, in sequence. Also included is a pump circuit means an alarm circuit means, which are responsive to the pump active state and the alarm active state.

BRIEF DESCRIPTION OF THE DRAWINGS

The above mentioned and other features and objects of this invention and the manner of attaining them will become more apparent and the invention itself will be best understood by reference to the following description of an embodiment of the invention taken in conjunction with the accompanying drawings, wherein:

Referring now to FIG. 1, the conventional operation of a commercially available reed switch 10 is illustrated. Magnet 12 is shown to illustrate the operation of a reed switch as it encounters a passing magnetic field. Reed switch 10 is to be taken as stationary in its shown position, and magnet 12 is illustrated as passing along a parallel line 14, and encountering and passing by the reed switch 10. In doing so, a conventional reed switch will exhibit three magnetically operational, active states 16, 18, and 20. Thus, as the magnet and associated magnetic field approach the reed switch from a lowest position, as soon as the magnetic field and associated magnetic lines of flux are in proximity to act upon reed switch 10, to act upon normally open reed switch 10, the magnetic field would act thereupon and cause the switch to close. As the magnetic field approaches the switch, zone 16 represents a magnetically active zone in which the reed switch 10 would remain closed. As the magnet 12 continues to pass along line 14, the reed switch 10 would experience a "dead zone" or inactive zone 22. This is caused by the inherent physical characteristics of the magnet and the associated magnetic flux which would act upon the magnetic reeds.

Figure 1:
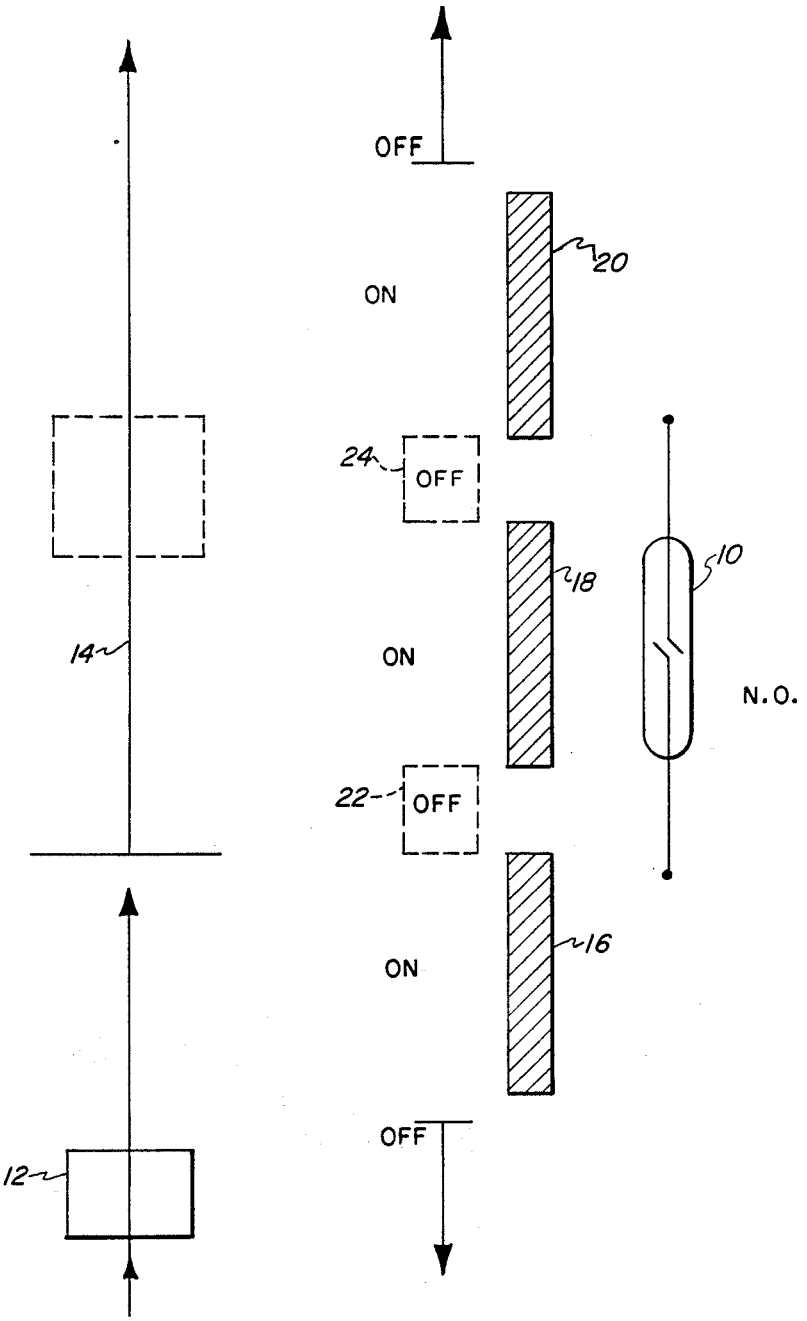
FIG. 1 is a diagrammetical representation of the operation of a conventional reed switch.

The "dead zone" would be experienced only briefly, and as the magnet continues to pass, the reed switch 10 would again be closed while the magnet is positioned and acting upon zone 18. Again as the magnet continues to travel along line 14 the reed switch 10 would experience a second "dead zone" 24. Finally, as the magnet continues to travel, reed switch 10 would be closed under the influence of a magnetic field while the magnet 12 is within operational zone 20. Subsequently, as the magnet would pass above zone 20, the magnetic field would b outside of the range necessary to act upon reed switch 10.

The foregoing illustrates how a conventional reed switch would exhibit three magnetically operational active zones. When a magnet is outside of these zones, the reed switch is in a rest or normal state and not being influenced by a magnetic field.

The instant invention intends on modifying the conventional reed switch to alter its magnetically operative states. It has been found that by shortening one lead of the reed switch, one can eliminate one of the three active states. By doing so the design accomplishes the goal of controlling the reed switch at critical points of operation. This will be further described in detail hereinafter.

Figure 2:
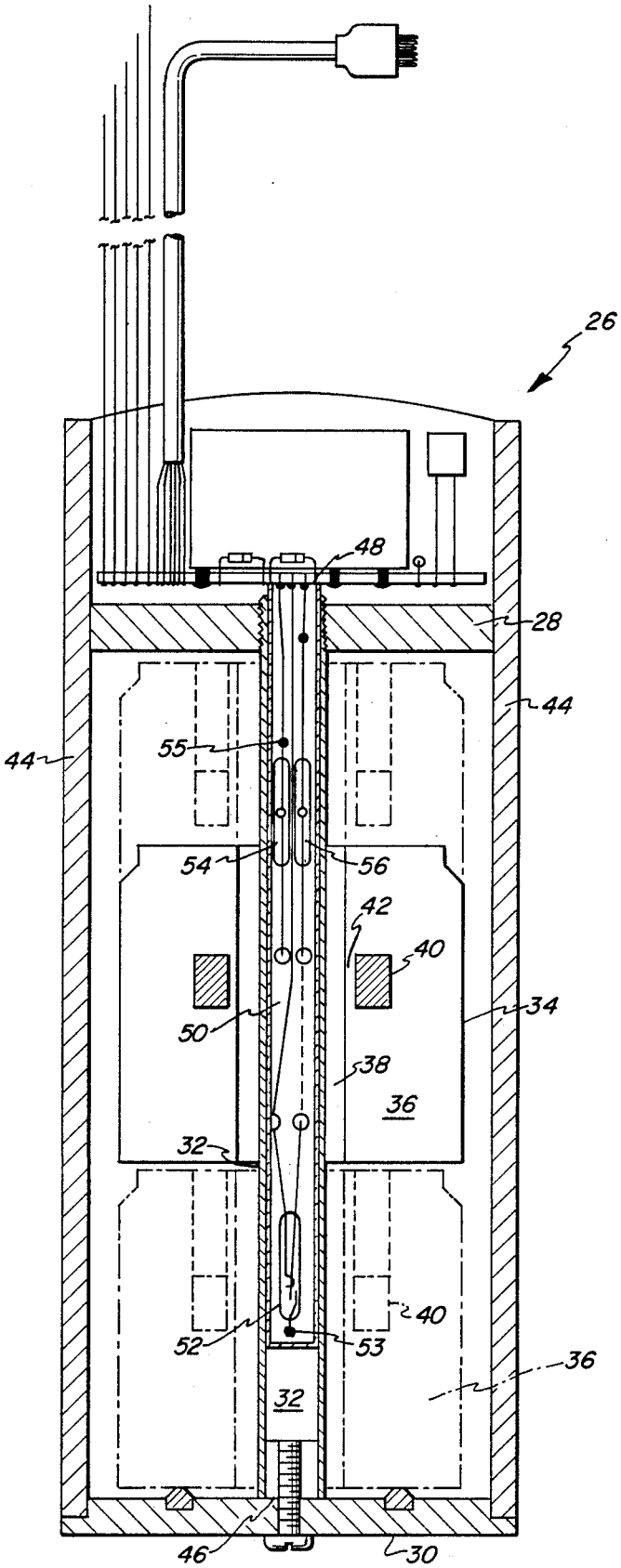
FIG. 2 is a partial side plan view illustrating a physical embodiment of the invention.

Referring now to FIG. 2 the invention is generally illustrated as having float support means 26. Float support means is comprised of top 28, bottom 30, and internal tube 32. Float means 34 is shown as slidably positioned about internal tube 32. In a particular embodiment float means is comprised of a generally cylindrical float 36 which contains a cylindrical coaxial void 38. Float 36 also includes magnet means 40 which is shown in cross section in FIG. 2. In a particular embodiment magnet means 40 is annular in shape and has portions defining an annular, coaxial void 42. The magnet is rigidly mounted within float 34 and travels therewith. The internal tube 32, as shown, passes within the voids of float 36 and magnet 40.

It can be seen that as the invention encounters a liquid rising from the bottom 30 towards top 28, the float 36 will likewise rise in accordance with the level of the fluid.

In an alternative embodiment, the invention includes cylindrical external walls 44 which have associated voids therein allowing the liquid to pass.

It is intended that the internal tube 32 be sealed with respect to any encountered liquid. Any conventional sealant can be used to conceal the tube and ends 46 and 48. Circuit board means 50 is shown in tube 32. Upon circuit board means 50 is mounted enable reed switch 52, alarm switch reed 54, and pump switch reed 56. The lower lead 53 of enable reed switch 52 is shown as significantly shortened and thereby modifying its magnetic and electrifying properties. Similarly, upper lead 55 of alarm reed switch 54 has also been significantly shortened which will also thereby modify its magnetic and electrical properties, as will be further described hereinafter.

It can be seen that alarm switch 54 and pump switch 56 are physically mounted in a parallel position upon circuit board means 50. This simplifies alignment and automatically accounts for accuracy and response of the invention.

In general, as liquid encounters the invention, the float and associated magnet would rise from bottom 30 towards top 28. As it does so normally closed enable switch 52 would close as the magnetic field is removed and does not act thereupon. As the magnet approaches the remaining reed switches, the invention would pass from a state wherein the pump is activated. The invention would continue in this state unless the liquid continues to rise. If this happens, the float would also continue to rise and would reach a state wherein both the pump switch and the alarm switch are activated.

Figure 3:
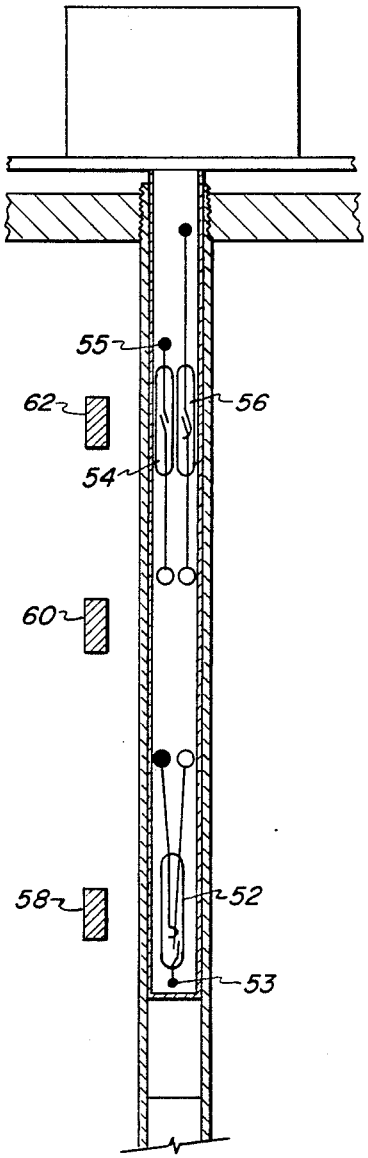
FIG. 3 is a diagrammetical representation of the physical placement of the reed switches of the present invention upon a circuit board.
Figure 4:
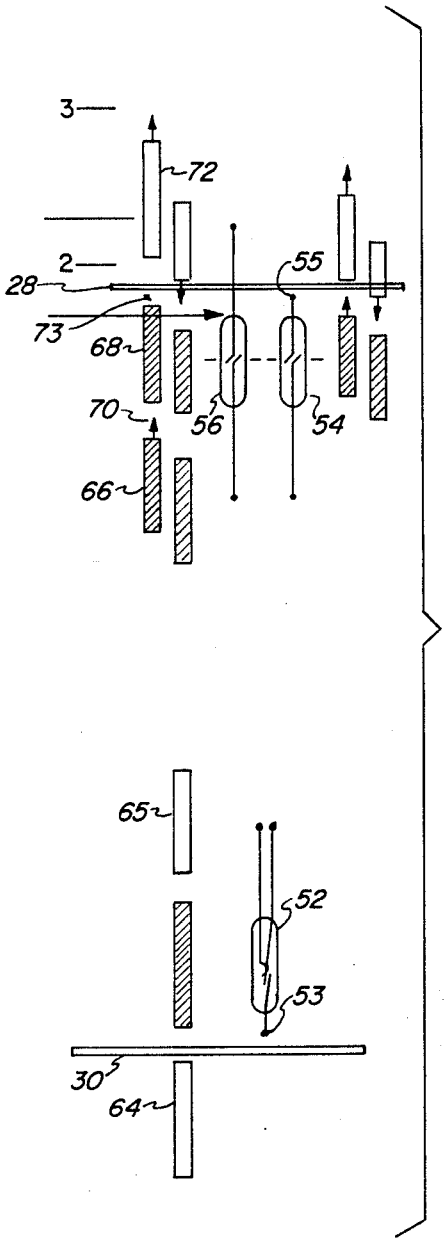
FIG. 4 is a diagrammetical representation illustrating the operation of the modified reed switches of the present invention.

Referring now to FIGS. 3 and 4, the magnetic and electrical characteristics of the invention will be further described. FIG. 3 illustrates a cross sectional portion 58 of magnet 40. When the float is in its lowermost state it is this position when the invention does not encounter any fluid and the associated bilge pumps are off. In this condition the magnet 58 would act upon enable reed switch 52. As this is a normally closed switch the magnetic field would act thereupon and cause the contacts to be "opened". Thus there would be a discontinuity in the associated electrical circuit means, and the circuit would be inactive.

As the level of liquid rises, the float would also continue to rise and the magnetic field would subsequently not act upon the enable reed switch. As the float and magnet 58 continue to rise, the magnetic field fails to act upon the enable reed. It should be noted that the lower short lead 53 of enable reed 52 eliminates a magnetically active state which would otherwise be associated with reed 52. By shortening the lower lead, an equivalent active zone 20 as shown in FIG. 1, does not exist. Thus enable reed 52 does not experience a "on-off-on" sequence of conditions as the float and magnet rise.

As the float further continues to rise, and the magnet is within zone 60 as illustrated in FIG. 3, the magnetic field will act upon pump reed 56. In this condition, the liquid has risen to a sufficient level that the pump is activated and will pump fluid from the vessel. The invention will remain in this state until a sufficient quantity of liquid is pumped from the vessel that the float drops and disables the pump switch.

Note that in this condition, the alarm reed is not activated. This is because of the shortened upper lead 55. By modifying this reed in this manner, an equivalent magnetically active zone 16, as shown in FIG. 1, is eliminated.

Should the liquid continue to rise, the invention would pass to an alarm mode. As the float and associated magnet physically approach zone 62, the magnetic field at this point would act upon both pump switch 56 and alarm switch 54. At this point the pump would be activated and removing liquid from the vessel and associated alarm circuitry would be enabled to provide visual and/or audio warnings to occupants of the vessel.

Alarm switch 54, and the associated alarm mode, are not required to practice the instant invention. They are optional selections based upon necessity or preference.

In the manner described above, by modifying conventional reed switches, and thereby altering their operational characteristics when subjected to the magnetic flux, the invention has accomplished the goal of minimizing the number of reeds required in order to maximize the sequence of events leading to an alarm condition.

The instant invention accomplishes the same operational modes with less structure than that disclosed in U.S. Pat. No. 4,186,419. This has been accomplished by modifying the reeds and incorporating the design of the altered magnetic characteristics into the invention. This has simultaneously allowed for the design of a physically smaller unit which can be adapted and incorporated into the dimensional limitations of particular boats, bilge areas, and bilge pumps. The unit is simply longitudinally smaller, because the shortened lead 53 eliminates the need for a cavity, or mounting structure, that would normally be required to facilitate longer leads. The instant invention accomplishes with three reed switches all of the functions that the Sims patent must accomplish with four reed switches. Similarly, the instant invention allows the various reed switches to be placed in closer proximity upon the circuit board and therefore the entire length of the unit is significantly diminished. It can thus be placed in a relatively small area.

Referring now to FIG. 4, bottom 30 prevents a physical barrier to the float and magnet 40. The float is prevented from passing below this base, and therefore normally magnetically active zone 64 is eliminated. As discussed above, the shortened lead 53 eliminates magnetically active zone 65.

As the magnet continues to rise upwards towards top 28, when the magnet encounters zone 66 magnetic field would act upon normally open pump switch 56 only, and cause its contacts to close. Because of the modified lead 55, when the magnet is in this physical condition it does not act upon alarm switch 54. As the magnet continues to rise and reaches zone 68 its magnetic field would operate upon both switches 54 and 56. This is the alarm condition. It should be noted that in continuing upward, the pump reed 56 would experience a dead zone 70. This however does not disactivate the pumps. The associated pump circuitry will "latch" which prevents the pump from shutting off.

As the float continues to rise it is physically constrained by top 28. In this manner, the otherwise active magnetic zone 72 and inactive zone 73, which would otherwise act upon switches 54 and 56, are never encountered and therefore never activated.

Figure 5:
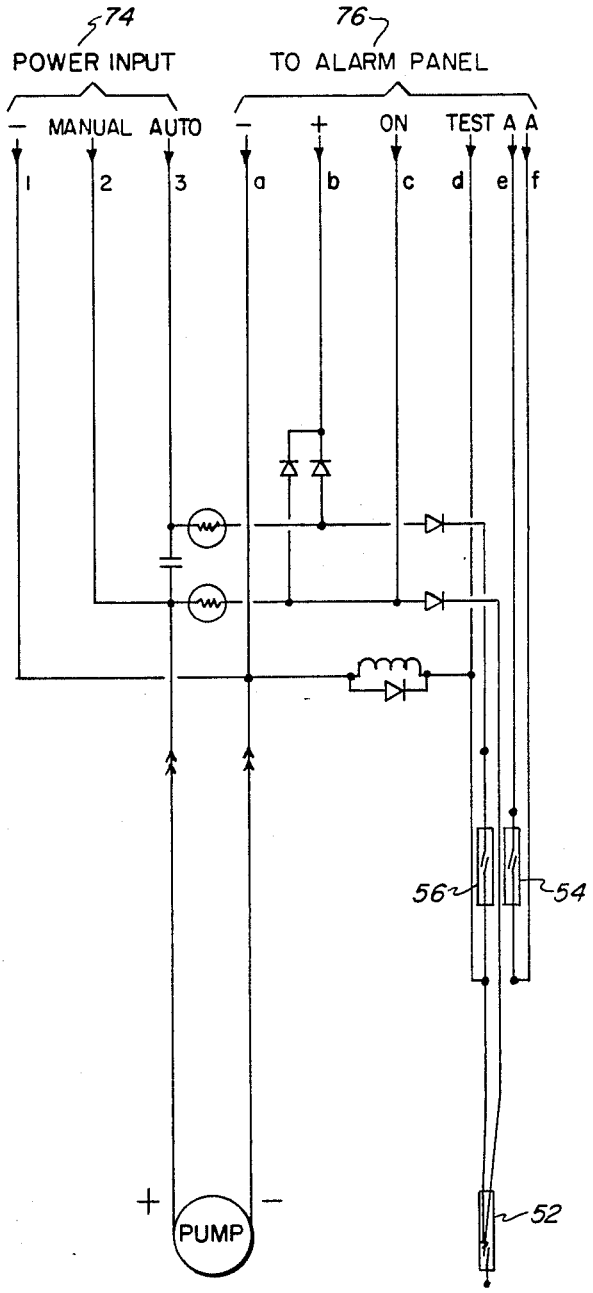
FIG. 5 is a schematic representation of a circuit means of the invention.

Referring now to FIG. 5, the pump circuit means 74 and alarm circuit means 76 are illustrated. It can be seen that enable switch 52, alarm reed 54 and pump reed 56 are merely circuit switches for the associated circuitry. When the contacts are closed there is of course a completed circuit line. It will be seen that the DC voltage inputs acting upon the pump and alarm circuit lines are enabled or disenabled by the respective switches. As is readily apparent to one of ordinary skill in the art, there are many equivalent circuits which can be designed and controlled by the reed switches.

While there have been described above the principles of this invention in connection with specific apparatus, it is to be clearly understood that this description is made only by way of example and not as a limitation to the scope of the invention.

What is claimed is:

1. A float switch, comprising:

float support means, said float support means including a top and a bottom and an internal tube, said internal tube being sealed with respect to a liquid encountering said float support means;

float means, said float means slidable positioned about said internal tube, said float means including magnet means, said float means being responsive to the level of said liquid;

circuit board means, said circuit board means being positioned within said internal tube;

a plurality of magnetic reed switches, said reed switches each having a sealed housing and being mounted upon said circuit board means, each said reed switch having two leads, each lead having portions extending and outside said sealed housing, said plurality including a first enable switch, a second pump switch and a third alarm switch, said pump switch and said alarm switch being physically aligned in parallel position above said enable switch, said enable switch and said alarm switch each being modified with one of said two external lead portions being substantially shortened with respect to the other external lead portion thereby modifying the reaction to a magnetic field, said modified reeds eliminating an otherwise conventionally occurring active state;

said magnetic means actuating said enable switch, said pump switch and said alarm switch, respectively, as said float rises in response to said liquid;

said plurality of reed switches providing an off state, a pump active state, and an alarm active state, in sequence; and circuit means, including pump circuit means and alarm circuit means, responsive to said pump active state and said alarm active state, whereby a float switch is provided utilizing a minimum number of modified reed switches to maximize the number and sequence of active circuit states and to provide a relatively small physical unit.

2. The apparatus of claim 2 wherein said float support means includes external cylindrical walls, said float means being positioned about said internal tube within said external walls, said walls having voids allowing liquid to pass therethrough, said float means movement being constrained by said float support means top and bottom.

3. The apparatus of claim 1 wherein said float means is cylindrical in shape and has portions defining a coaxial cylindrical void;

said magnet means being an annular, magnetic disk and having a coaxial, annular void;

said internal tube passing through said voids.

4. The apparatus of claim 1 wherein said enable switch is normally closed and has its lowermost lead shortened;

said alarm switch and said pump switch are normally opened, said alarm switch having its uppermost lead shortened;

said enable switch and said alarm switch having only one magnetically active state resulting from said shortened leads and said float means movement constraints imposed by said float support means top and bottom.

5. The apparatus of claim 4 wherein said pump switch is magnetically actuated as said float means approaches, at this instance said alarm switch not being magnetically actuated as a result of said shortened lead;

both said pump switch and said alarm switch being magnetically actuated as said float means continues to rise.

6. A float switch for automatically controlling the level of liquid in a marine craft, and for use in conjunction with bilge pumps and the like, comprising:

a float support, said float support including cylindrical, external walls and a circular top disc and a circular bottom disc, and further including an internal tube, said external walls having portions defining voids, said voids allowing liquid to pass therethrough, said internal tube being sealed with respect to said liquid;

a float, said float being generally cylindrical in shape and having portions defining a coaxial, cylindrical void, said float being slidably positioned about said internal tube, said float including a magnet, said magnet being an annular magnetic disc and having a coaxial, annular void, said internal tube passing through said voids, said float being responsive to the level of said liquid;

circuit board means, said circuit board means being positioned within said internal tube;

a plurality of magnetic reed switches, said reed switches each having a sealed housing and being mounted upon said circuit board means, each said reed switch having two leads, each lead having portions extending inside and outside said sealed housing, said plurality including a first enable switch, a second pump switch, and a third alarm switch, said pump switch and said alarm switch being physically aligned in parallel position above said enable switch, said enable switch and said alarm switch each being modified with one of said two external lead portions being substantially shortened with respect to the other external lead portions thereby modifying the reaction to a magnetic field, said modified reads eliminating an otherwise conventionally occurring act of state;

said enable switch being normally closed and having its lowermost lead shortened, said alarm switch and said pump switch being normally open, said alarm switch having its uppermost lead shortened, said enable switch and said alarm switch having only one magnetically active state resulting from said shortened leads and said float means movement constraints imposed by said float support top and bottom;

said magnet actuating said enable switch, said pump switch and said alarm switch, respectively, as said float rises in response to said liquid;

said plurality of reed switches providing an off state, a pump active state, and an alarm active state, in sequence, said pump switch being magnetically actuated as said float approaches, at this instant said alarm switch not being magnetically actuated as a result of said shortened lead, both said pump switch and said alarm switch being magnetically actuated as said float continues to rise; and circuit means, including pump circuit means and alarm circuit means, responsive to said pump active state and said alarm active state, whereby a marine float switch is provided utilizing a minimum number of modified reed switches to maximize the number and sequence of active circuit states and also to provide a relatively small physical unit capable of being adapted to dimension constraints of particular vessels and structure.

7. A float switch, comprising:

float support means, said float support means including a top and a bottom and an internal tube, said internal tube being sealed with respect to a liquid encountering said float support means;

float means, said float means slidably positioned about said internal tube, said float means including magnet means, said float means being responsive to the level of said liquid;

circuit board means, said circuit board means being positioned within said internal tube;

a plurality of magnetic reed switches, said reed switches each having a sealed housing and being mounted upon said circuit board means, each said reed switch having two leads each and outside said sealed housing, said plurality including a first enable switch and a second pump switch, said pump switch being physically aligned above said enable switch, said enable switch being modified with one of said two external lead portions being substantially shortened with respect to the other external lead portion thereby modifying the reaction to a magnetic field, said modified reed eliminating an otherwise conventionally occurring active state;

said magnetic means actuating said enable switch and said pump switch, respectively, as said float rises in response to said liquid;

said plurality of reed switches provide an off state and a pump active state in sequence; and circuit means, including pump circuit means responsive to said pump active state.

* * * * *